US005528101A

United States Patent [19]

Gosslar et al.

[11] Patent Number: 5,528,101

[45] Date of Patent: Jun. 18, 1996

[54] SINGLE-ENDED LOW-POWER DISCHARGE LAMP, AND METHOD OF ITS MANUFACTURE

[75] Inventors: Achim Gosslar, Munich; Ulrich Henger, Wipperfürth; Juergen Heider, Munich, all of Germany

[73] Assignee: Patent-Treuhand-Gesellschaft F. Elektrische Gluehlampen mbH, Munich, Germany

[21] Appl. No.: 125,120

[22] Filed: Sep. 22, 1993

[30] Foreign Application Priority Data

Oct. 5, 1992 [DE] Germany ..... 42 33 469.1

[51] Int. Cl.[6] ..... H01J 1/62; H01J 17/18; H01J 17/04

[52] U.S. Cl. ..... 313/493; 313/623; 313/631; 313/632

[58] Field of Search ..... 313/493, 63, 631, 313/632

[56] References Cited

U.S. PATENT DOCUMENTS

| | | | |
|---|---|---|---|
| 4,434,386 | 2/1984 | Lowe . | |
| 4,658,177 | 4/1987 | Gosslar | 313/25 |
| 4,717,852 | 1/1988 | Dobrusskin et al. . | |
| 4,723,092 | 2/1988 | Heider et al. . | |
| 4,739,220 | 4/1988 | Dobrusskin et al. . | |
| 4,850,499 | 7/1989 | White et al. . | |
| 4,998,036 | 3/1991 | Matsuura et al. . | |
| 5,037,342 | 8/1991 | Barthelmes et al. . | |
| 5,051,655 | 9/1991 | Wiley | 313/631 |
| 5,142,195 | 8/1992 | Heider et al. . | |

FOREIGN PATENT DOCUMENTS

| | | |
|---|---|---|
| 0219860 | 4/1987 | European Pat. Off. . |
| 0369370 | 5/1990 | European Pat. Off. . |
| 0374677 | 6/1990 | European Pat. Off. . |
| 0451647 | 10/1991 | European Pat. Off. . |
| 1425956 | 2/1966 | France . |
| 3939193A1 | 6/1990 | Germany . |
| 0476833 | 12/1937 | United Kingdom . |

OTHER PUBLICATIONS

JP–A–56 168 318, Patent Abstracts of Japan, vol. 6, No. 55, Apr., 1982, Mitsubishi Denki K.K.

JP–A–01 220 362, Patent Abstracts of Japan, vol. 13, No. 534, Nov. 1989, Toshiba Corp.

*Primary Examiner*—Sandra L. O'Shea
*Assistant Examiner*—John Ning
*Attorney, Agent, or Firm*—Frishauf, Holtz, Goodman, Langer & Chick

[57] ABSTRACT

The discharge or arc tube chamber of a low-power high-pressure discharge lamp is, in one single step, sealed and shaped by mold or form-blowing by using pinch or press jaws (30, 31) which have concave hollows (34) formed therein to clearly define the shape of the discharge vessel, and hence of the discharge or arc tube chamber, to permit reproducible results with little variation between individual lamps to be made in a single manufacturing step. Additionally, an inclined ramp-like surface can be formed at the narrow sides (14) of the pinch seal extending towards the walls (11) of the discharge chamber (3) to thereby eliminate pockets beneath the electrodes. Preferably, the electrode shafts diverge with respect to the optical axis (A) of the lamp to increase the electrode spacing, and thus permit operation at a lower operating pressure, with respect to prior art lamps.

5 Claims, 4 Drawing Sheets

SINGLE-ENDED LOW-POWER DISCHARGE LAMP, AND METHOD OF ITS MANUFACTURE

Reference to related patents, the disclosure of which is hereby incorporated by reference, assigned to the assignee of the present application:

U.S. Pat. No. 4,717,852, Dobrusskin et al
U.S. Pat. No. 4,723,092, Heider et al
U.S. Pat. No. 4,739,220, Dobrusskin et al
U.S. Pat. No. 5,037,342, Barthelmes et al
U.S. Pat. No. 5,142,195, Heider et al Reference to related patents, the disclosure of which is hereby incorporated by reference:

U.S. Pat. No. 4,998,036, Matsuura et al
U.S. Pat. No. 4,850,499, and its Continuation U.S. Pat. No. 4,850,500, White et al (both of which correspond to combined Published European Patent Application 0 271 927).

Reference to related publication:

German Patent Disclosure Document DE-OS 39 39 193, Heyde et al.

FIELD OF THE INVENTION

The present invention relates to a method to make a single-ended low-power discharge lamp, and to the lamp made by that method, and more particularly to a single-ended, single-based, single pinch-sealed high-pressure discharge lamp of small power rating. "Small power rating", as used herein, refers to power ratings of generally about between 35 W and 150 W.

BACKGROUND

Single-ended, single-based, pinch-sealed high-pressure discharge lamps of small power rating, as defined, are frequently used for interior illumination, display, and store window illumination and the like, and particularly in situations where the lamps operate continuously for substantial periods of time. The lamps have high light output and good color rendition. Examples of such lamps are described in the referenced U.S. Pat. Nos. 4,717,852, Dobrusskin et al, assigned to the assignee of the present application, and 4,998,036, Matsuura et al.

The lamps typically have a discharge vessel of quartz glass which, frequently, is surrounded by an outer bulb. The discharge vessel has two electrodes located therein between which an arc is struck. The electrodes are angled off to face each other at electrode tips. The discharge vesel or arc vessel has an ionizable fill, usually including an ignition gas, metal vapors and metal halides.

Manufacture of single-ended pinch-sealed lamps, particularly with small discharge vessels, is substantially more difficult than double-ended pinch-sealed lamps. In manufacture of a single-ended lamp, the single pinch seal has a tendency to distort the symmetry of the discharge chamber within the discharge vessel much more than if a double pinch-sealed vessel is used, that is, if the lamp is a double-ended pinch-sealed lamp. The operating pressure of single-ended lamps is usually higher, up to about 50 bar, due to the smaller electrode spacing and the more uniform heating of the discharge chamber. Consequently, the danger of rupture or bursting of the discharge chamber is higher than in a comparable double pinch-sealed lamp, where the pressure rises usually only up to about 28 bar. Very low powered lamps, particularly lamps below 100 W, hardly ever use double pinch-sealed or doubled-ended discharge chambers because heat losses are more pronounced than in single-ended versions. The volumes of the discharge chamber are very small, typically only between about 0.1 to 3 $cm^3$. These small volumes require meticulous care in the manufacture, in order to reduce the range of variation in the volume of the discharge vessel, and thus to reduce changes in characteristics of the discharge vessel within a given rating to an acceptable limited degree.

The referenced U.S. Pat. No. 5,037,342, Barthelmes et al, describes, as background, a typical sequence of manufacturing steps. A quartz tube is so shaped that a pumping or exhaust tube is formed, and then the tube is heated and, upon introduction of an inert gas under overpressure, the discharge volume is formed by blowing pressurized gas into the soft quartz-glass tube. The blowing region is unsupported, so that the discharge volume is blown without support or back-up. In a subsequent step, and while an inert gas is used to flush the interior of the vessel, the pump tube can be tipped off and the opposite end of the glass tube is pinch-sealed by two pinch-sealing jaws, after the glass has been suitably heated to permit deformation.

It has been found in practice that the free or unrestrained blowing of the glass results in discharge chambers, the volume of which varies considerably between serially manufactured lamps. Further, the subsequent pinch-sealing has the tendency to deform the discharge vessel subsequent to blowing, which additionally contributes to the undesired spread in characteristics of the lamps, and which leads to a non-homogeneous distribution of wall thickness of the discharge vessel.

The referenced U.S. Pat. No. 5,037,342, Barthelmes et al, therefore proposes not to use a pumping tube and, instead of the pumping tube, to close off the end of the glass vessel by a form roller and, by blow-molding, to precisely define the final form of the arc tube or arc vessel to be made. Then, after flushing and introducing the fill through the still open second end of the tube, the glass tube is pinch-sealed.

It has been found that this method, also, can be improved. The fill already has been introduced during heating preparatory to the final pinch-sealing step, which requires cooling of the fill, while the portion of the quartz tube to be pinch-sealed must be heated. This is a complicated, and hence expensive step. Also, the already precisely preformed discharge chamber can be deformed again during the pinch-sealing step.

The referenced German Patent Disclosure Document 39 39 193, Heyde et al, describes a method for low-power halide metal discharge lamps in which, first, a pinch seal is formed and, at the same time, a discharge chamber is preformed. Only thereafter is the discharge chamber blown to receive the finally shape—apparently over the still open stub. This arrangement permits a better control of the volume of the discharge vessel and to maintain the volume almost precisely as desired—at the cost, however, of a time-consuming and energy-intensive manufacturing process since the form-blowing requires a second heating step for the discharge vessel.

THE INVENTION

It is an object to provide a method to make a discharge vessel, and the discharge vessel for a single-ended, high-pressure discharge lamp, so that the lamps can be made accurately and reproducibly; the method should be fast, economical, and economical in energy use. Additionally, the lamps so produced should have improved operating safety and reliability.

Briefly, a tubular quartz-glass element is first formed, the tubular glass element having a first, open end and a second dome-like endi from which a pump or exhaust tube extends. The pump or exhaust tube can be integral with the glass element or added to a dome-like end. A jig or holder holds an electrode system which includes two spaced electrodes, and electrode supply leads including, for example, molybdenum foils. The electrode system is introduced through the open end of the quartz tube, the interior of the quartz tube is flushed, and the glass tube element is heated. These three steps, introduction of the electrode system, flushing and heating, can be carried out in any desired sequence. Then, in one, essentially simultaneous step, and while the glass tube element is soft, the pinch or press seal is formed with pinching or pressing jaws which contain mold forms for the discharge vessel or arc tube itself to be formed, and an inert over-pressurized gas is introduced into the still soft discharge vessel through the pump tube to blow the discharge vessel to assume the shape of the mold form portions of the pinch or press jaws. Thereafter, a fill is introduced into the now formed arc or discharge chamber through the exhaust tube which, then, is tipped off.

In accordance with the invention, thus, the sealing and final shaping of the discharge vessel chamber is carried out in a single operating step. This step, preferably, is carried out by four pinch jaws, namely two main pinch jaws which flatten the seal, and two auxiliary lateral pinch jaws, so that the pinch or press seal, in cross section, will have an essentially double-T or an I cross section. The pinch or press jaws have a portion which provides at least part of the final shape of the discharge or arc tube which, in the finished lamps, forms the discharge chamber. For exact conformity of the glass against the jaws, an inert gas, for example nitrogen or argon, is introduced through the pump tube, with some overpressure, into the future discharge chamber. Preferably, the four pinch jaws, that is, the main pinch jaws as well as the auxiliary or lateral pinch jaws, include an extension portion which forms a mold for the discharge vessel or arc tube, or at least the portion near the pinch seal, so that separate molding structures need not be used. This results in lamps in which the discharge vessel is particularly easily reproducible. Variations in volumes of discharge vessels made in accordance with this process can be reduced from a prior variation range of about 7% to desired values of about 4%.

The process has a particular advantage since simultaneously making the pinch seal as well as shaping the discharge vessel or arc tube permits effective shaping of the transition region between the discharge vessel or arc tube and the pinch seal itself. To make lamps with improved transitions, the lateral pinch seals are formed with inclined ramps, which so shape the transition region that a well-defined slanted or inclined portion of glass will be formed between the wall of the discharge chamber and the narrower sides of the pinch seal. This defined inclined portion is located essentially beneath the discharge chamber or arc tube chamber. Pockets which otherwise might result are effectively eliminated by the lateral bracing effect of the lateral or auxiliary pinch jaws which, otherwise, could form in the transition region between the discharge chamber and the pinch seal during a pinching operation.

Pockets which extend from an otherwise internally smooth discharge chamber increase the volume of the discharge chamber in unpredictable amounts, and, in single-ended lamps, reduce the resistance of the lamp with respect to bursting or explosion. The projecting slanting welts or ramps on the lateral or auxiliary sealing jaws guide the soft quartz, during pinch-sealing, in the direction of the pinch seal, so that such pockets cannot form at all. This increases the resistance against bursting or pressure by about 20%.

The problem of pockets is well known—see the referenced White et al U.S. Pat. Nos. 4,850,499 and 4,850,500. The pockets referred to in these disclosures result in an undesired decrease of the "cold spot" temperature in the zone behind the electrodes. These pockets are removed by forming depressions in the wall of the discharge vessel by projections extending in right angles from the lateral pinch jaws.

The inclined portions formed in the lamps in accordance with the present invention must be clearly distinguished from the single pinch-sealed lamps shown in U.S. Pat. No. 4,998,036, Matsuura et al. In accordance with the Matsuura disclosure, the inclined regions are located slightly below the electrodes and laterally adjacent the discharge vessel, and are intended to increase the cold-spot temperature behind the electrodes, but they have no function during manufacture or to improve the bursting resistance, nor are they used to eliminate pockets below the actual discharge chambers. Pockets will not be formed in the lamp of this disclosure since the discharge vessel apparently is closed off only by two pinch jaws, as can be gleaned from considering the substantially greater width of the pinch seal with respect to the discharge chamber.

In accordance with a feature of the present invention, the slanted or inclined regions are inclined by about 20° to 30° with respect to the lateral or narrow side of the pinch seal; such inclinations effectively and most reliably avoid the formation of pockets.

Optimum guidance of flow of the soft quartz-glass, during pinch sealing, is obtained by forming the main pinch jaws with lateral inclinations which cooperate with the projecting ramps or welts of the lateral or auxiliary pinch jaws in what might be termed a pincer-like cooperation. The lateral inclination of the main pinch seal, in this pincer-like region, should be less by about 15–30% than that of the projecting ramps or welts of the lateral or auxiliary jaws. This results in flow of quartz material away from the discharge chamber. The discharge vessel will have an essentially double-T shaped pinch thereon, at which the outer edge has a greater inclination, particularly by about 15–30%, than the inner edge of the inclined portion or rim formed thereon.

Mechanized manufacture can be improved and increased by using, in accordance with a feature of the present invention, a preforming step in which the tubular element is roughly preformed before closing and final forming. Thus, a portion, or the entire tube, is formed to have, approximately, the general finally desired shape.

In accordance with a preferred feature of the invention, the open end of the tube can be so deformed, after initial heating by pressure deformation, that it will have an approximately oval cross section. Various technologies to obtain this cross section are known, see for example the referenced patents assigned to the assignee of the present application, U.S. Pat. Nos. 4,723,092, Heider et al, and 4,739,220, Dobrusskin et al.

Preforming the open end of the tube facilitates introduction of the electrode system and also prevents adhesion on the glass wall of foils, typically molybdenum foils, or of the electrodes.

Another, or additional possibility, in accordance with the present invention, for preforming the final discharge chamber is to heat the region of the subsequent discharge chamber and, while closing the open end of the tube, form-blowing the chamber to approximate the final shape. This permits shaping of the region of the discharge chamber close to the pump tube, a region which, in final shaping, is frequently not effectively reached. In many cases, particularly in larger lamps having a greater discharge chamber, preforming by rollers in the region close to the pump tube satisfies these requirements.

Preforming the future pinching or pressing region, particularly by form pressing, has the specific advantage when electrode systems have electrode shafts which are inclined with respect to the optical axis. In accordance with a feature of the invention, the electrode shafts diverge slightly, by about 5° *for example*, outwardly from the pinch seal in the base end, thus increasing the electrode spacing. Increased electrode spacing results in a higher arc voltage, thus reducing the operating pressure, which, in turn, increases safety against bursting or explosion. These advantages are available for all lamps in which the electrodes diverge within the discharge chamber, independent from the manufacturing process. The combination of inclined ribs or inclined regions at the narrow sides of the pinch seal with diverging electrodes results in particularly improved operating safety and reliability.

DRAWINGS

FIG. 1*a* is a highly schematic side view of a metal halide discharge lamp in accordance with the present invention, and made by the method in accordance with the present invention;

FIG. 1*b* is a sectional view along lines Ib—Ib of FIG. 1*a*, and showing, schematically, a cross section through the press seal;

FIG. 2, collectively, shows manufacturing steps of making the discharge vessel, in which:

FIG. 2*a* shows the quartz glass being heated;

FIG. 2*b* the heated quartz glass being drawn;

FIG. 2*c* the end of the heated quartz glass being shaped and preformed by a roller;

FIG. 2*d* the tube being preformed by forming jaws;

FIG. 2*e* insertion of the electrode system into the open end of the quartz tube;

FIG. 2*f* illustrating heating of the glass tube preparatory to finish-forming and pinch-sealing in one step;

FIG. 3*a* is a highly schematic front view of the forming jaws, in which the forward main forming jaw is partly broken away, and illustrating simultaneously pinch or press-sealing and finish-forming the discharge chamber; and FIG. 3*b* is a top view of the forming jaws during the simultaneous forming and pinch-sealing step.

DETAILED DESCRIPTION

Figure 1A:
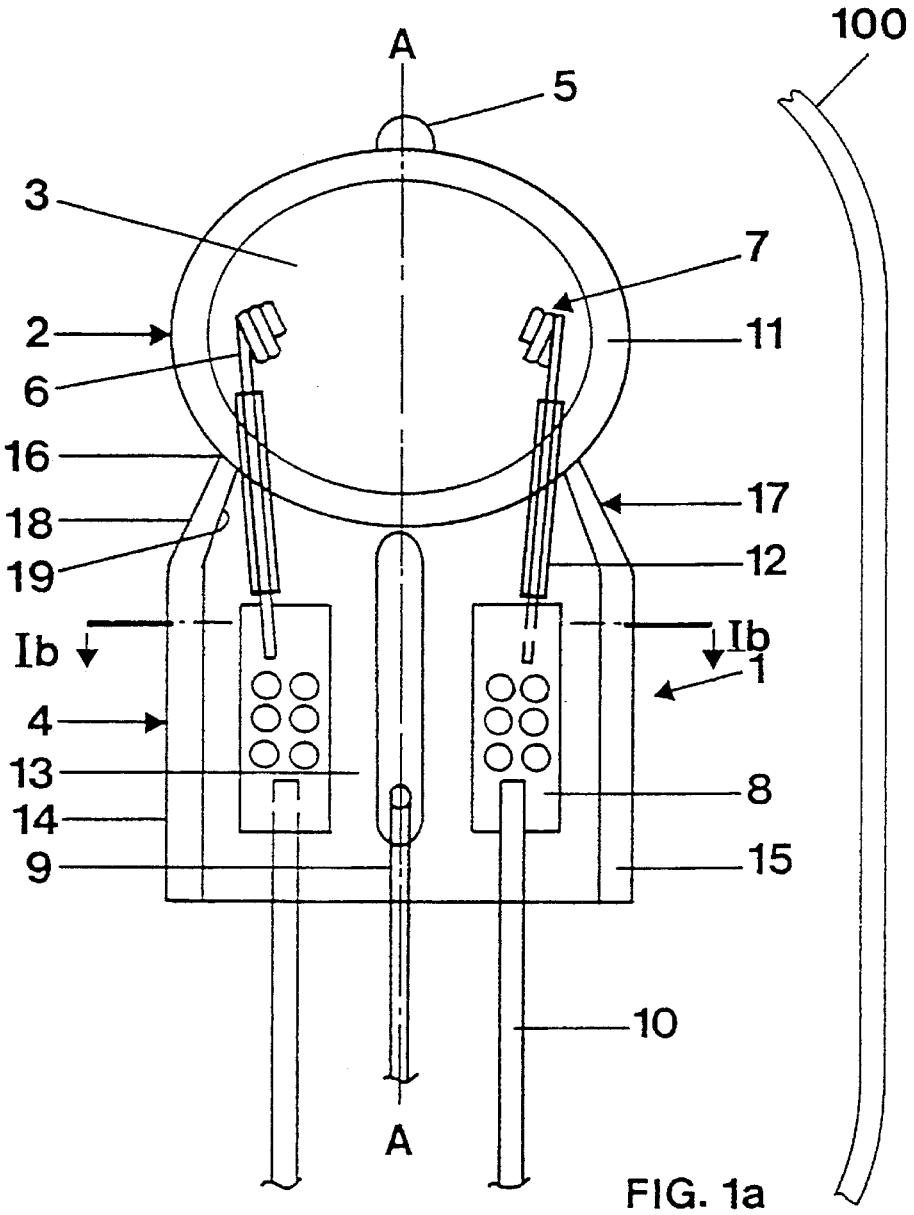

The invention will be described with reference to a 35 W high-pressure metal-halide discharge lamp 1 which has a single-ended pinch or press-sealed discharge vessel 2 of quartz glass. The discharge vessel 2 may have various shapes and, in the embodiment illustrated, is essentially ellipsoid- shaped; it may, however, also be barrel-shaped, or spherical, or have other suitable forms. The discharge vessel or arc tube 2 encloses a discharge chamber or arc chamber 3. The discharge vessel may be located within an outer bulb 100, of any suitable and conventional shape, and shown only in fragmentary, highly schematic representation.

The discharge chamber 3 terminates at one side in a pinch or press seal 4; at the opposite side, the chamber 3 is closed off by a tipped-off pump tube stub 5. The electrodes are formed as straight shafts 6 with tips 7 fitted thereon, bent over at an approximately right angle, so that they face each other.

Figure 1B:
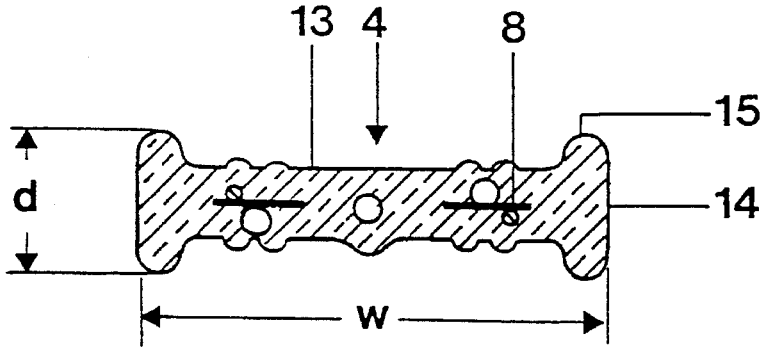

In accordance with a feature of the invention, the shafts 6 are inclined by about 5° with respect to the optical axis A outwardly and upwardly, as seen in FIG. 1. The tip 7 can be a wound tip or can be spherical or have any other suitable shape. Molybdenum foils 8 are melt-sealed in the pinch seal 4, connecting the electrodes 6 to current supply leads 10 leading outwardly of the pinch seal. The pinch seal also retains a holding wire 9 for a getter, which may be used if the discharge tube is enclosed within the outer bulb 100, and which is evacuated, or retains an inert fill. The current supply leads 10, melt-sealed into the pinch seal 4, and typically of molybdenum, simultaneously form the holding arrangement for the discharge vessel 2 with respect to a base or within an outer bulb 100.

The discharge chamber 3 within the discharge vessel 2 has an inner volume of about 0.11 $cm^3$. It retains a fill which, for example, is composed of NaI, $SnI_2$, TlI and Hg. The fill further includes argon as an ignition gas. The wall thickness of the arc tube 2, that is, of the material surrounding the discharge chamber 3, is about 1.3 mm. This wall 11 is formed by the blow-molding step to be described, in ellipsoid form having a longer half-axis of about 9 mm, located in a connecting line connecting the electrode tip 7. The ellipsoid-shaped vessel further has two smaller half axes, located at right angles to the longer half axis, each smaller half-axis having about 4.8 mm overall length. Operating pressure is between about 35 to 40 bar, which is only about 80% of the value usually used in discharge vessels of this size.

In accordance with a feature of the invention, the electrode shafts 6 are not parallel to the optical axis A but, rather, are outwardly inclined upwardly within the pinch seal 4 (see FIG. 1*a*) and continues from the base region of the discharge vessel by about 5° with respect to the optical axis. This inclination permits a relatively large spacing of the electrode tips from each other, namely of about 5.2 mm, which is longer than the prior art lamps of similar types which have an electrode spacing of about 4.5 mm. This permits the lower operating pressure, only about 80% of the previously used values, in operation of the lamp.

The electrode shafts are of wire form with a diameter of about 0.3 mm. The current which flows through the shaft 6 is about 0.5 A.

Arrangements of this type are subject to malfunction or to the danger of a spurious arc discharge between the shafts 6 at the point at which they exit from the wall 11 of the discharge vessel 2. To prevent such spurious arcs, it is desirable to surround the shafts 6 with a sleeve 12 of insulating material. Suitable insulating materials are ceramics or quartz glass.

The pinch seal 4 closing off the discharge vessel 2 is, in cross section, of the well-known double T shape, or also known as an I-beam shape. The double T shape is formed by the trunk portions of the two T parts, with the cross bar portions being at right angles thereto and remote from the abutment of the trunk portions. The length of the pinch seal, measured in the direction of the molybdenum foils 8, is about 35 mm. At the wider sides 13, the pinch seal has a width w of about 11 mm, which corresponds roughly to the maximum width of the discharge vessel 2. The thickness or depth d of the narrow sides 14, including the bead or welt 15 formed by the cross bar portion of the double T shape, is about 5 mm.

In accordance with a feature of the invention, the narrow sides 14 of the pinch seal are connected to the wall 11 of the discharge chamber over an inclined or slanted portion 17, joining the wall 11 of the discharge vessel 2 at a junction point 16. The outer surface or respectively, in side view, the outer edge 18 of the slanted portion 17 is inclined by about 26° with respect to the optical axis A. The welt or bead 15 forms an inner edge or inner region 19 of the slanted or inclined portion which is inclined by a lesser angle with respect to the axis A, roughly by about 20° with respect to the axis A. As a consequence, the bead or welt 15 will taper towards the junction 16, being wider in the region of the pinch or press seal. Pockets are optimally avoided by so locating the inclined or slanted portions 17 that they meet the discharge vessel roughly at the level of the lower inner end portion of the discharge chamber 3 and extend essentially below this end portion.

The invention is suitable for lamps of various sizes. See, for example, the table at the end of the specification. Data for the 35 W lamp have been incorporated into the table for comparison purposes.

Example of manufacture of the discharge vessel, with reference to FIG. 2, collectively.

A quartz tube 20 is placed in a rotating holder, rotating as schematically shown by arrow B. It is heated by a gas burner 21 centrally of the glass tube—see FIG. 2*a*—until it can be drawn outwardly, as shown by arrows C1, C2, FIG. 2*b*. Two tubular portions 20*a*, 20*b* are thus obtained having a central portion 22 of smaller diameter, and transition zones 23 between the tubes 20*a*, 20*b* and the drawn-apart portion 22. The portion 22 will, subsequently, form two exhaust tubes or exhaust stubs.

The two tubular parts 20*a*, 20*b* are severed in the center to leave the two stubs 22' and the transition region 23 is heated by a gas burner 21' (FIG. 2*c*) and shaped by a rotating form roller 24 to form a dome-shaped end portion 23', which at this point, will have the desired radius of the dome of the future discharge chamber. The width of the heating zone from the burner 21' and the shape of the form roller 24 are the controlling parameters determining this desired radius.

Figure 2A:
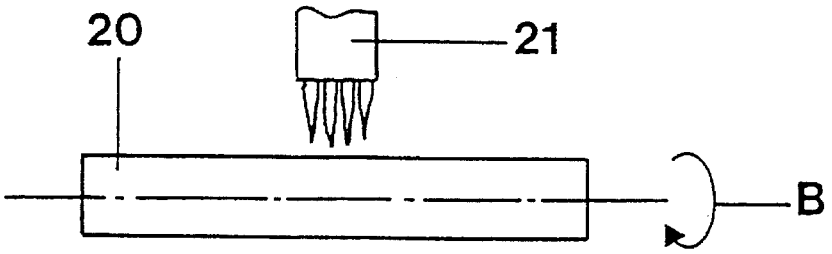
Figure 2B:
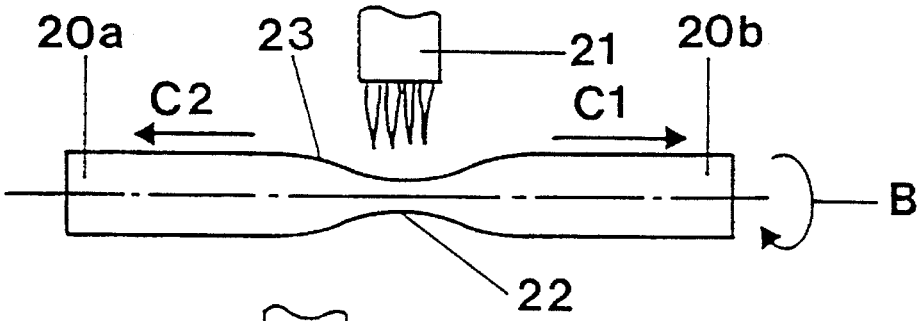
Figure 2C:
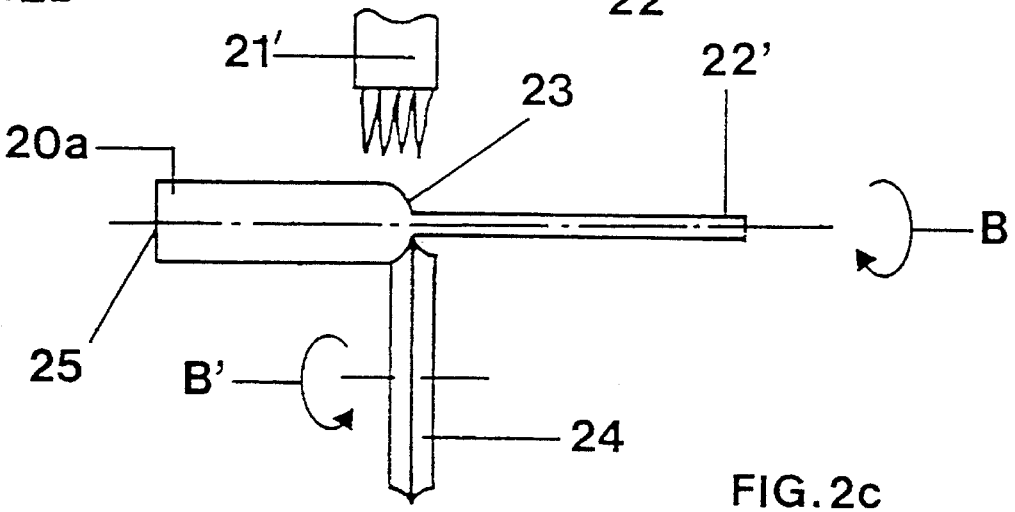
Figure 2D:
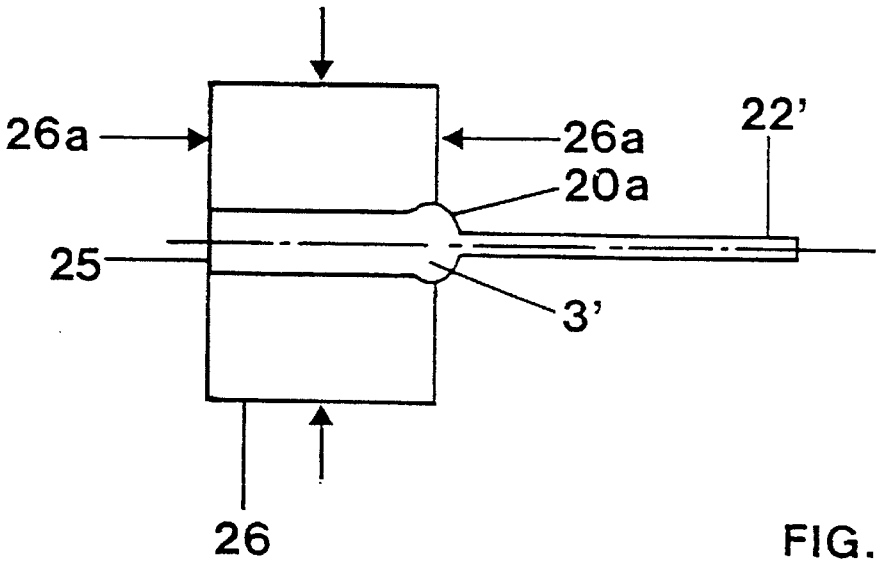

The still open end region 25 of tube 20*a* is then moderately heated and deformed by forming jaws 26 to receive an oval cross section, as schematically shown in FIG. 2*d*. Preferably, the forming jaws 26 have a width 26*a* which is sufficient to roughly preform the shape of the future discharge chamber 3'.

Figure 2E:
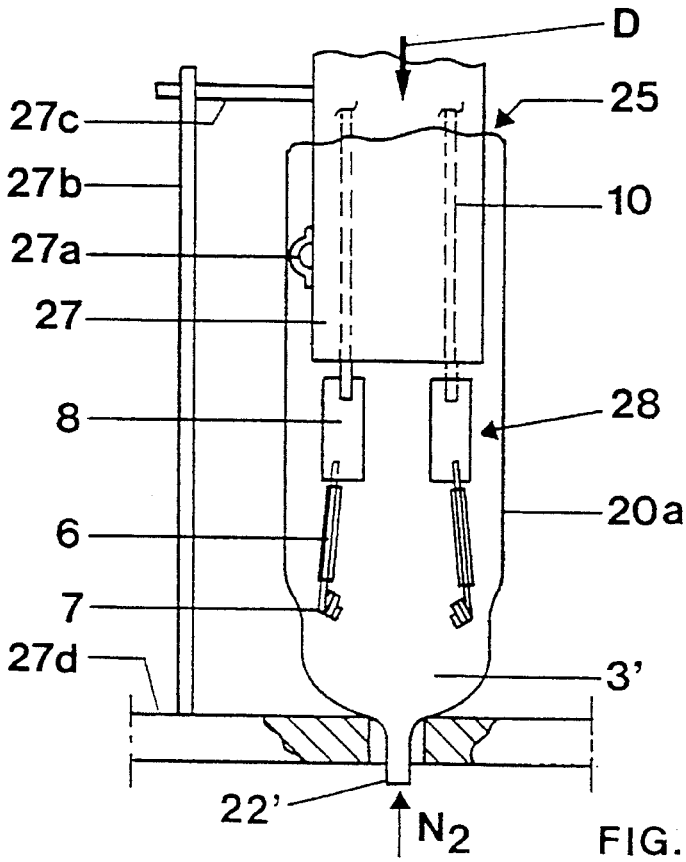

An electrode system 28 (FIG. 2*e*) is then prepared. The electrode system includes the current supply leads 10, sealing foils 8, electrode shafts 6 and electrode tips 7, in which the electrode shafts 6 are already inclined outwardly by about 5°. This electrode system 28, held in a suitable jig or fixture 27, is introduced into the open preformed end 25 of the tubular element 20*a*, in the direction of the arrow D, as seen in FIG. 2*e*. Nitrogen ($N_2$) or some other inert gas is introduced through the pumping tube stub 22' for flushing and cleaning the discharge vessel. The jig or holder 27 has springy positioning elements 27*a*, slightly projecting outwardly. Three such elements are preferably used, of which only one is visible in FIG. 2*e*. These projecting positioning elements 27*a* engage against the inner wall of the tubular glass element 20*a* so that the jig or holder will position itself. The defined position of the electrode system 28 within the future discharge vessel 3' is obtained by introducing the jig or fixture 27 into the open end 20*a* with an arm 27*c* which connects the jig or holder to a vertical bar or rod 27*b*, engaging an abutment or engaging surface 27*d*. When the rod 27*b* engages the surface 27*d*, the electrodes are properly positioned within the preformed glass element. This step is well known and therefore not shown in detail.

Figure 2F:
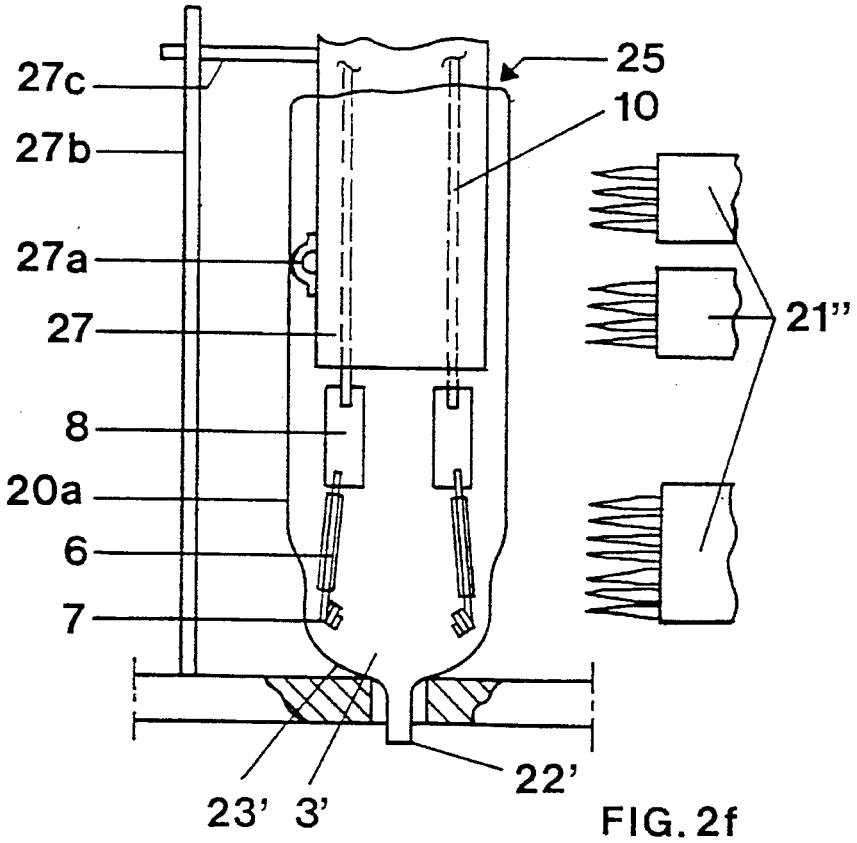

In the next step, see FIG. 2*f*, the entire tubular element 20*a*, with the exception of the pumping tube 22' and the immediately adjacent dome-shaped region 23', is heated by gas burners 21" to softening, that is, working temperature.

Figure 3A:
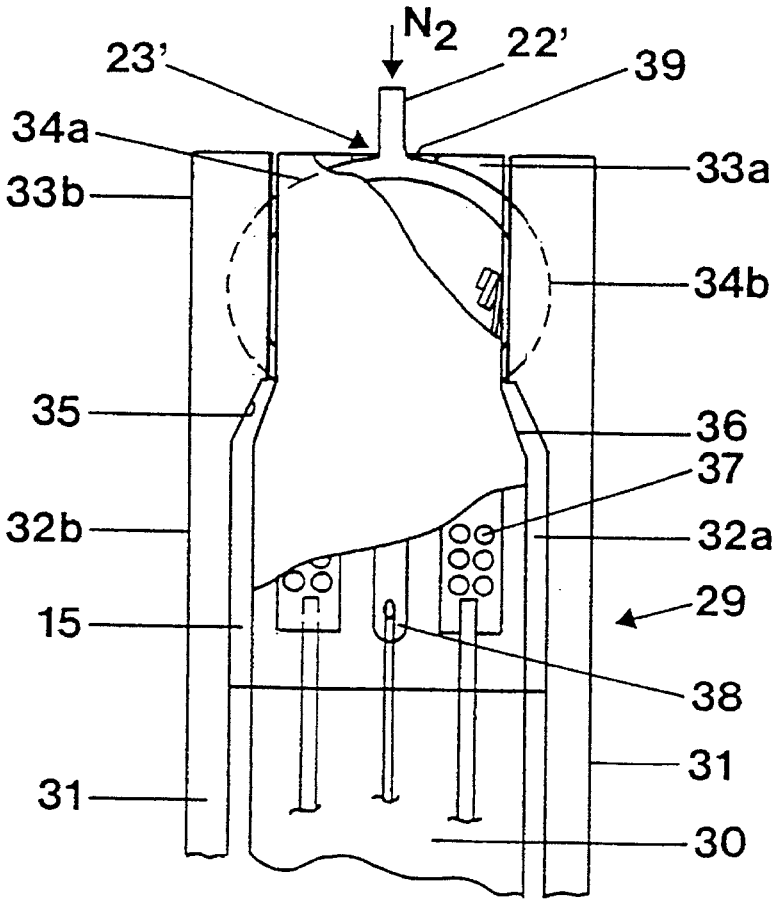

In accordance with a feature of the invention, the lamp is then pinch-sealed and shaped, essentially simultaneously, in one step. To carry out the step, a pinch or press mold combination is used in a pressing machine 29 (FIGS. 3*a*, 3*b*), which has two main pinch jaws 30 and two lateral or auxiliary pinch jaws 31. In FIG. 3*a*, one of the main pinch jaws 30 is partly broken away for better illustration. Upon moving the pinch jaws towards each other, the open tubular end 20*a* (FIG. 2*f*) is sealed off by a double-T pinch or press seal.

In accordance with a feature of the invention, the pinch or press jaws 30, 31 not only have the pinch or press surfaces 32*a*, 32*b* but additionally have attached or extended extension portions or elements 33*a*, 33*b*. These extension portions or elements have concave hollows 34*a*, 34*b*, shown in broken lines in FIG. 3*b*, at the sides facing the tubular element 20*a*. When the jaws are closed, that is, in pinch-sealing position of the pinch press 29, they almost engage against each other, and define the precise shape of the discharge chamber.

Shortly after the pinch jaws 30, 31 are moved towards each other, that is, after a few hundred milliseconds, nitrogen ($N_2$) or another inert gas is introduced through the pump tube or stub 22' under slight overpressure into the future discharge vessel, so that the discharge chamber 3 is reliably and reproducibly formed within the region of the extension portions or elements 33*a*, 33*b*.

In accordance with a feature of the invention, the transition zone between the pinch jaw portions 32*a*, 32*b* and the extension portions or elements 33*a*, 33*b* includes inclined ramps 35, 36 forming the inclined or slanted region 17 (FIG. 1) at the narrow side of the pinch seal. The inclined transition surfaces 35 of the lateral or auxiliary jaw coact with the inclined surfaces 36 in the transition region between the jaw portions 33*a*, 34*a* of the main jaws 30. The inclinations 36 gradually reduce the width of the pinch surfaces 32*a* of the main jaws 30 to the width of the associated extension portion 33*a*, and form the inner edge 19 of the inclined portion or slanted portion of the discharge vessel, when it is finished—see FIG. 1.

Figure 3B:
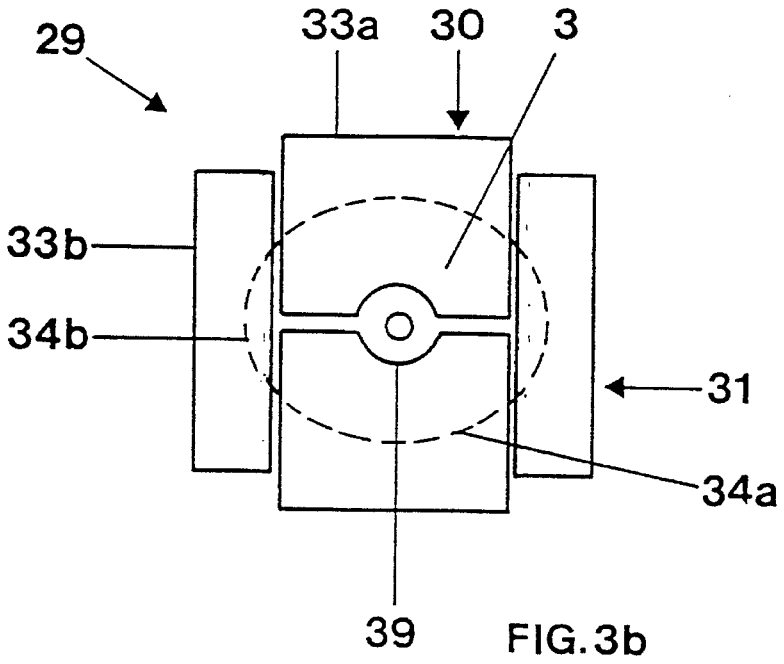

FIG. 3*b* illustrates the four pinch jaws 30, 31 in closed position, that is, as they carry out the pinch or press seal. As can be seen from FIG. 3*b*, the jaws do not completely engage against each other but, rather, leave some gaps or some space, so that the bead or rib 15 can form in the region of the pinch surfaces 32*a*, 32*b*. Thus, bead 15 of the double-T pinch seal is formed. The pinch surfaces 32*a* of the main pinch jaws 30 additionally are formed with centering bumps 37 and centering depressions 38 for the current supply leads 6 and for the centrally positioned getter holding wire 9. The main pinch jaws 30 are formed with a recess 39 at that position where the pump tube 22 fits against the discharge vessel 3, that is, in the region of the top or zenith of the pinch jaws. To avoid interference with the stability of the dome-shaped region and the pump stub, the dome region is not heated, and the jaws do not carry out any forming function at the dome end of the discharge vessel.

The discharge vessel 3, formed by the jaws 30, 31, is then filled with an ionizing fill through the pump tube stub 22', the stub is heated, and the pump tube 22' is tipped off, so that only the tipped-off end 5 will remain.

The process, as described, can be changed in various ways. For example, preforming may be eliminated, especially if electrode shafts are used which extend parallel to the optical axis A.

The pump stub 22' need not be integral with the discharge vessel; rather, a separate pump stub can be fitted to the reduced end portion 23 or 23' of the heated tube, so that the pulling step of the heated tube—see FIG. 2*b*—is not used. It is possible to heat the tubular element 20*a* to pinching temperature already before the electrode system 28 is introduced. Cleaning by flushing can also be carried out at any desired time within the overall process.

Various changes and modifications may be made, and any features described herein may be used with any of the others, within the scope of the inventive concept.

| Power Rating, W | 35 | 70 | 150 |
|---|---|---|---|
| Discharge Chamber, $cm^3$ | 0.11 | 0.28 | 0.82 |
| Operating Pressure, bar | 35–40 | 35–40 | 25–30 |
| Longer Half Axis; mm | 9 | 10.8 | 15 |
| Shorter Half Axes; mm | 4.8 | 7 | 10.2 |
| Lamp Current, A | 0.5 | 0.9 | 1.8 |
| Electrode shaft/, mm (Diameter) | 0.3 | 0.4 | 0.5 |
| Electrode spacing, mm | 5.2 | 5.0 | 7.7 |

What is claimed is:

1. Low-power high-pressure discharge lamp (1), said lamp defining an optical lamp axis (A), having a discharge vessel or arc tube (2) of quartz glass, the walls (11) of which define a discharge or arc tube chamber (3);

a single pinch or press seal (4) sealing the chamber;

two electrodes (6, 7) and electrical connection means (8, 10) extending through the pinch or press seal and electrically connected to the electrodes, wherein the pinch or press seal (4), in cross section, is essentially double-T or I-shaped and defines two essentially flat broad sides (13) and two narrow or end sides (14), at essentially right angles to said flat broad sides, said pinch or press seal further comprising beads or welts (15) projecting beyond said flat broad sides, and wherein, in accordance with the invention, a slanted or inclined connecting region (17) is provided, connecting the narrow sides (14) of the pinch seal (4) to the wall (11) of the discharge vessel, said slanted or inclined connecting region being primarily located below the discharge or arc tube chamber (3);

said slanted or inclined connecting region (17) has an outer edge portion (18) which is more sharply inclined than an inner edge portion (19), said edge portion being derived from said bead or welt (15) of the pinch seal; and wherein the angle of inclination of the surface of the outer edge portion (18) of the connecting region (17) is between about 20° to 30° with respect to the optical lamp axis (A).

2. The lamp of claim 1, wherein the slanted or inclined connecting region (17) has an outer surface (18) which is inclined with respect to the axis (A) of the lamp.

3. The lamp of claim 1, wherein the angle of inclination of the surface of the inner edge portion (19) of the connecting region at the slanted portion (17) is about 15° to 30° less than that of the angle of inclination of the surface of the outer edge portion (18).

4. The lamp of claim 1, wherein the electrodes include essentially straight electrode shafts (6) and bent-over electrode tips (7);

and wherein, the electrode shafts (6) are inclined with respect to each other, said inclination diverging, with respect to said lamp axis, in a pinch or press seal (4) to increase the spacing of the electrode tips (7) from each other.

5. The lamp of claim 4, wherein the degree of inclination of the electrode shafts (6) is in the order of about 5° with respect to the optical lamp axis (A).

* * * * *